US006419111B1

(12) United States Patent
Kepner

(10) Patent No.: US 6,419,111 B1
(45) Date of Patent: Jul. 16, 2002

(54) ONE-SIDED BEVERAGE VESSEL

(75) Inventor: Erl E. Kepner, Boulder Creek, CA (US)

(73) Assignee: Y-Spin Inc., Boulder Creek, CA (US)

( * ) Notice: Subject to any disclaimer, the term of this patent is extended or adjusted under 35 U.S.C. 154(b) by 0 days.

(21) Appl. No.: 09/821,173

(22) Filed: Mar. 28, 2001

(51) Int. Cl.[7] ..... B65D 43/18
(52) U.S. Cl. ..... 220/705; 220/710.5; 220/756
(58) Field of Search ..... 220/705, 710.5, 220/756

(56) References Cited

U.S. PATENT DOCUMENTS

| | | | | |
|---|---|---|---|---|
| 4,191,302 A | * | 3/1980 | Fiducia | 220/705 |
| 4,607,755 A | * | 8/1986 | Andrzozzi | 220/705 |
| 6,182,854 B1 | * | 2/2001 | Jimenez et al. | 220/705 |
| 6,321,977 B1 | * | 11/2001 | Lee | 220/705 |

OTHER PUBLICATIONS

Acme Klein Bottle of 6270 Colby St., Okland, CA 94618 Makes a "Klein Bottle Mug" Which is However not a One Sided Beverage Vessel. Please See Attached Sheet Showing Their Design and Read Specification for More.

* cited by examiner

*Primary Examiner*—Joseph M. Moy

(57) ABSTRACT

A beverage vessel (10) whose constriction resembles a typical coffee mug except for the fact that the hollow handle (16) of the beverage vessel (10) is hollow with one end of the hollow handle (16) connected to the container (12) at a normal location; at the bottom side of the container (12), with the hollow handle (16) then passing over lip of the container (12) at the opening (14) of the container (12) with the other end of the hollow handle (16) connecting to the container (12) at the bottom of the container (12). The hollow handle (16) hollow feature extends through its connections to the container (12) on both the lower side and bottom of the container (12). This configuration allows a communication between the environment outside of the beverage vessel (10) container (12) through the hollow handle (16) at the bottom of the container (12) and the contents of the container (12) through the hollow handle (16) connected at the lower side of the container (12. The resulting beverage vessel (10) is much like the "Klein Bottle" and allows for the removal of the container (12) contents by the application of a partial vacuum beneath the bottom of the container (12) thus sucking the container (12) contents through the hollow handle (16) and ejecting the contents out of the hollow handle (16) at the bottom of the container (12).

3 Claims, 9 Drawing Sheets

ONE-SIDED BEVERAGE VESSEL

BACKGROUND—FIELD OF INVENTION

This invention relates to beverage vessels, specifically to an improved connection of the hollow handle to the beverage vessel container, which results in a one-sided beverage vessel and allows communication between the environment external to the beverage vessel and the container contents through the opening in the hollow handle.

BACKGROUND—DESCRIPTION OF PRIOR ART

The use of household vessels to contain food and beverage as well as to be used for storage and display of possessions dates back to antiquity and there are tens of billions of these vessels in use world wide.

The origin for the basic topological shape of this invention; One-sided Beverage Vessel, goes back to the mid eighteen hundreds. On Apr. 25, 1884, a boy was born in Dusseldorf Prussia named Felix Christian Klein. Dr. Klein died on Jun. 22, 1925. Dr. Klein was a professor of mathematics and is the inventor (discoverer) of what is now called the "Klein Bottle". The Klein Bottle is a unique topological structure. The Klein Bottle is a hollow structure that has only one surface. Perhaps you have seen a more commonly known two-dimensional structure, with only one side; called the "Mobius Loop"? The Mobius Loop is what you get when you take a strip of paper, give one end of it a half twist and than tape the ends together. The Mobius Loop has only one side: i.e., a pen can make a line from any point on the surface to any other point on the surface without crossing over an edge. The Klein Bottle is a similar structure except that it is a structure with an internal volume and only one surface. A true "Klein Bottle" cannot be constructed in our normal three-dimensional space (four dimensions counting time) however the basic concept is embodied in this invention. The one-sided beverage vessel is a practical application of the topological structure inspired by the Klein Bottle.

To help us see the unique properties of the beverage vessel, lets pretend that the vessel is made of astonishingly thin material. This is a "thought experiment", not a real experiment, where you actually physically do anything. Note that the only edge on the vessel is the rim that your lips would touch if you drank coffee from it. The rim of the container would be a very sharp edge while the areas where the container and the hollow handle come together would be smooth curved shapes. Now pretend that you have a very tiny little black ball shaped magnet located on the surface of the vessel somewhere and another little tiny white ball magnet located on the opposite side of the vessel material. If one were to (mentally) move either the black or white ball magnet, it would cause the white or black ball magnet to move also. One could move the black or white ball magnets, one at a time, along the vessel surface so that white ball magnet ended up where the black ball magnet was initially located and the black ball magnet was where the white ball magnet originally was. This can be accomplished without having either of the magnets pass over the vessel rim, which is the only edge of the vessel. Other than the Klein Bottle, no other hollow shape has this property. Another way to envision or demonstrate the unique properties of this shape is to point out the fact that a little bug can crawl from any point on the surface of the vessel to any other point on the surface of the vessel without crossing over an edge. Bugs cannot do this on a normal coffee cup or any other three-dimensional shape that we use in our daily lives.

To picture the shape of a Klein Bottle, it might help to envision a hollow pear shape made of transparent material that is easily stretched and shaped however you like. Again, this is a thought experiment. Lay the hollow pear on its side and than make the following changes in order to make it into a three-dimensional rendition of the Klein Bottle. First, make three holes in the hollow pear. Make a large sized hole in the top of the large end of the pear, make a medium sized hole at the bottom middle portion of the pear and make a small hole at the very tip of the thin end of the pear; where the stem of the pear would be. Stretch the thin end of the hollow pear so that it is lengthened like a hose and pull it through the large hole you made at the top of the large end of the pear shape. Continue pulling the thin hollow stretched portion through the hole, without touching the, edge of the large hole in the pear, and join the material around the small hole to the material around the medium sized hole at the bottom of the pear so that it is now hermetic at that joint. This is the basic shape of the Klein bottle in our three dimensional world. The vessel of this presentation is a modification of the original Klein Bottle shape. The modified shape is achieved by enlarging the large hole at the top of the pear shape and changing the basic pear shape to one more like a typical coffee mug while moving the elongated small end of the hollow pear towards the side of the new shape to make the hollow handle.

The only reference that I have been able to find to an application of the unique properties of a Klein Bottle for use in a beverage container or any consumer product is a coffee mug which is called a "Klein Bottle Mug" manufactured and sold by ACME KLEIN BOTTLE, a division of Nocturnal Aviation at 6270 Colby Street, Oakland Calif. 94618. The ACME KLEIN BOTTLE company has a web site which shows various views and pictures of the ACME KLEIN BOTTLE products and can be seen at; "http://wwww.kleinbottle.com".

One of the ACME KLEIN BOTTLE company products is a coffee mug called the "Klein Bottle Mug". The Klein Bottle Mug is, however, not a one-sided mug. The Klein Bottle Mug has a much more complex structure and is definitely not a one-sided structure. One cannot successfully perform the thought experiments of the "little crawling bug" or the "two little magnets" with the ACME Klein Bottle Mug.

The "One-sided Beverage Vessel" of this presentation can be used to demonstrate the unique properties of the Klein Bottle. This beverage vessel can also be used in applications where it is advantageous to be able to empty the container contents without pouring the contents over the lip of the container. An example of the possible need for this would be if an aircraft pilots beverage vessel would need to be emptied rapidly due to air turbulence. In normal use, the pilot would handle and drink from the vessel just as with any other coffee cup. However, while the vessel was sitting on the surface that the pilot used for such purposes it could be emptied by the application of a partial vacuum; from beneath the surface that the beverage vessel was resting on. The vacuum required would be provided by using either a commonly available vacuum pump or vacuum storage tank whose vacuum was appropriately applied by use of a commonly available switch or valve. Commonly available motion sensors can e used to sense and trigger the valve. The application of a partial vacuum beneath the vessel would result in the vessels contents being forced out of the hole at the bottom of the beverage vessel.

The future marketing of the beverage container of this invention will use these sorts of interesting points to stimulate interest among technically well educated people and everyday people with a innate curiosity and appreciation for the wonder and beauty of mathematics and nature.

OBJECTS AND ADVANTAGES

Accordingly, besides the objects and advantages of the beverage vessel described in the above patent application, several objects and advantages of the invention are:

(a) to provide a beverage vessel that satisfies the typical objectives of a such a beverage vessel while offering a unique and curious appearance;

(b) to offer a real world example of a three dimensional utilitarian object that approximates the Klein Bottle in having, not an inside surface and an outside surface, but only a single surface;

(c) to provide a show-and-tell example of a one-sided object for use in teaching mathematics students the interesting aspects of topology;

(d) to provide a beverage vessel that can be handled in the normal manner yet emptied, without having the beverage vessel contents flow across the lips of the container opening, by the application of a reduced air pressure at the surface that the beverage vessel is resting on.

Further objects and advantages are apparent when the beverage vessel is utilized in a larger size than the normal beverage vessel for the transfer of fluids from the large sized vessel to a different container, for further processing, by the application of a partial vacuum pressure at the bottom of the vessel.

DRAWING FIGURES

In the drawings, closely related figures have the same number but different alphabetic suffixes.

FIG. 1A shows a perpendicular cross sectional view of the beverage vessel centered on the hollow handle.

FIG. 1B shows a side view of the beverage vessel perpendicular to the plane of the hollow handle.

FIG. 1C shows a side view of the beverage vessel parallel with the plane of the hollow handle from the handle side of the beverage vessel.

FIG. 1D shows a top view of the beverage vessel.

FIG. 1E shows a top bottom of the beverage vessel.

FIG. 2A shows a perpendicular cross sectional view of the beverage vessel centered on the hollow handle.

FIG. 2B shows a side view of the beverage vessel perpendicular to the plane of the hollow handle.

FIG. 2C shows a side view of the beverage vessel parallel with the plane of the hollow handle from the handle side of the beverage vessel.

FIG. 2D shows a top view of the beverage vessel.

REFERENCE NUMERALS IN DRAWINGS

10 beverage vessel

12 container

14 opening

16 hollow handle

SUMMARY

In accordance with the present invention a beverage vessel comprises a container with a hollow handle hermetically joined to the container at the bottom of the container and extending over the lip of the container with its other end hermetically joined to the lower side of the container so that the volume within the container communicates through the hollow handle with the ambient volume below and external to the container.

Description—FIGS. 1 to 3

Figure 1A:
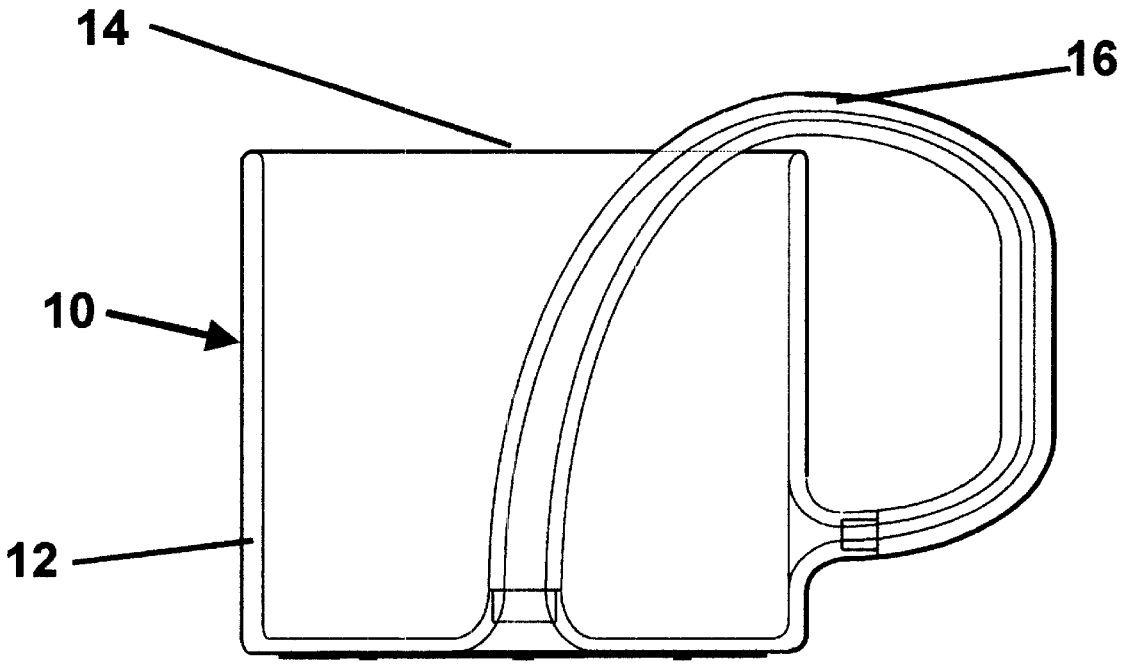
FIGS. 1A to 1E show various views of a straight sided beverage vessel with the portion of the hollow handle to container connection, within the container volume, radially centered and sloping towards the portion of the lip of the container closest to the hollow handle's connection at the side of the container.
Figure 1B:
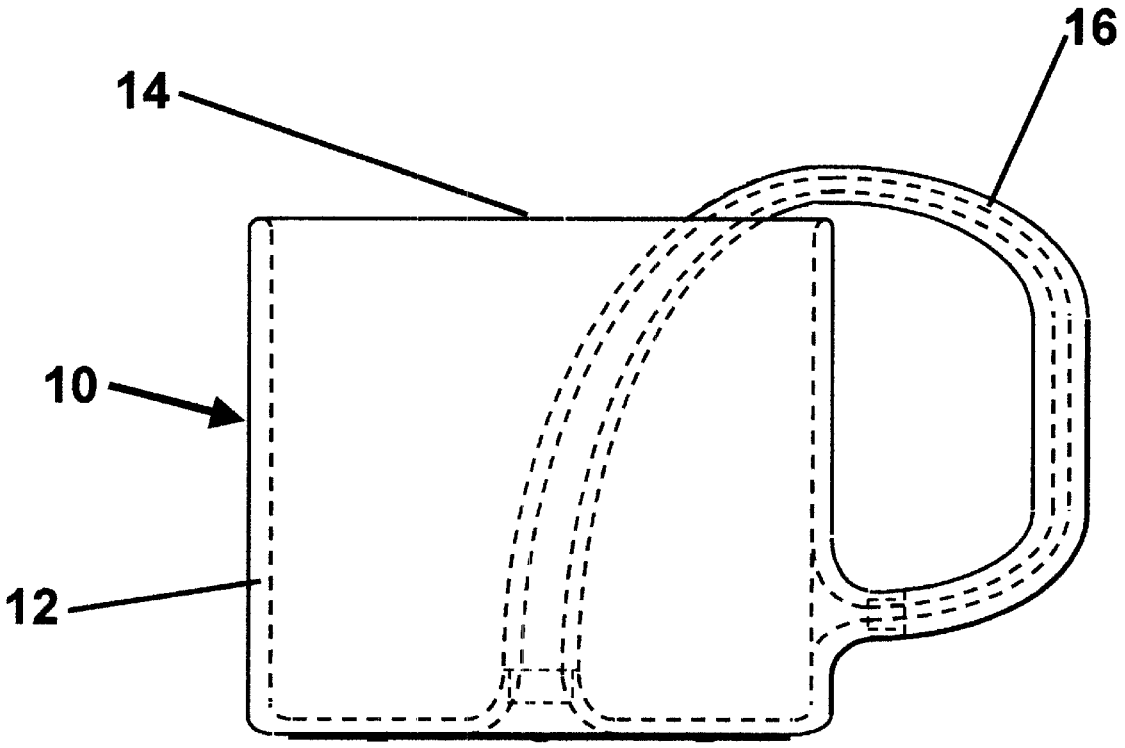
Figure 1C:
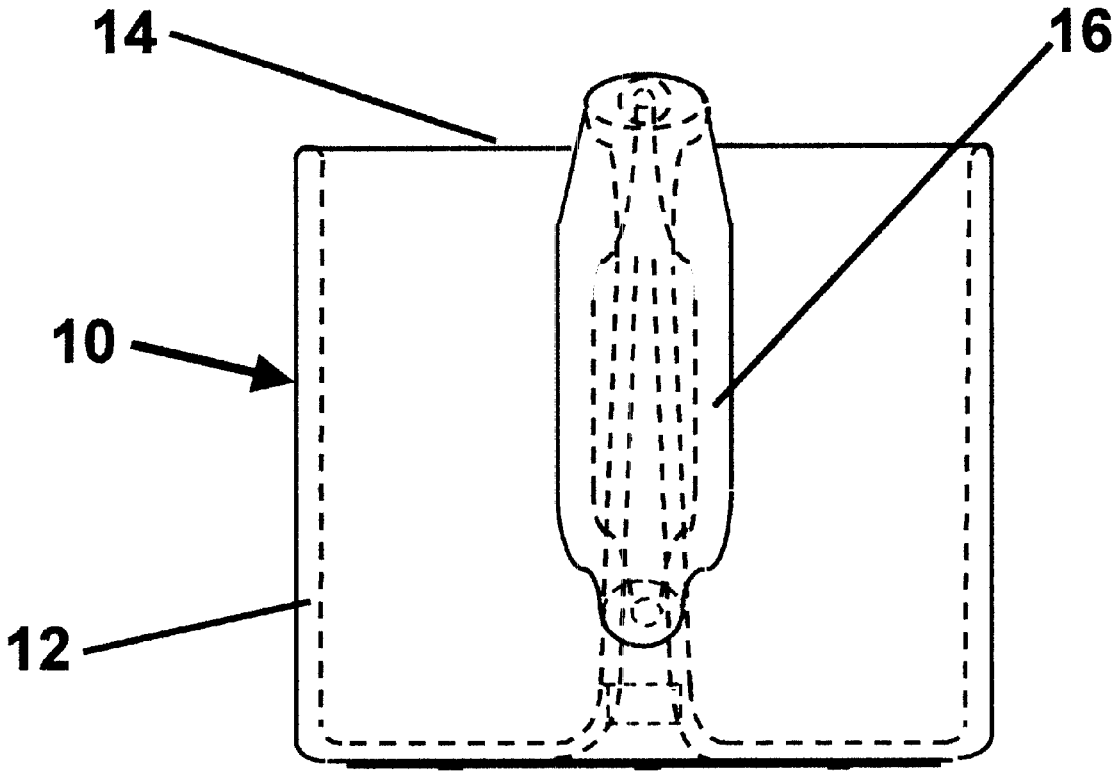
Figure 1D:
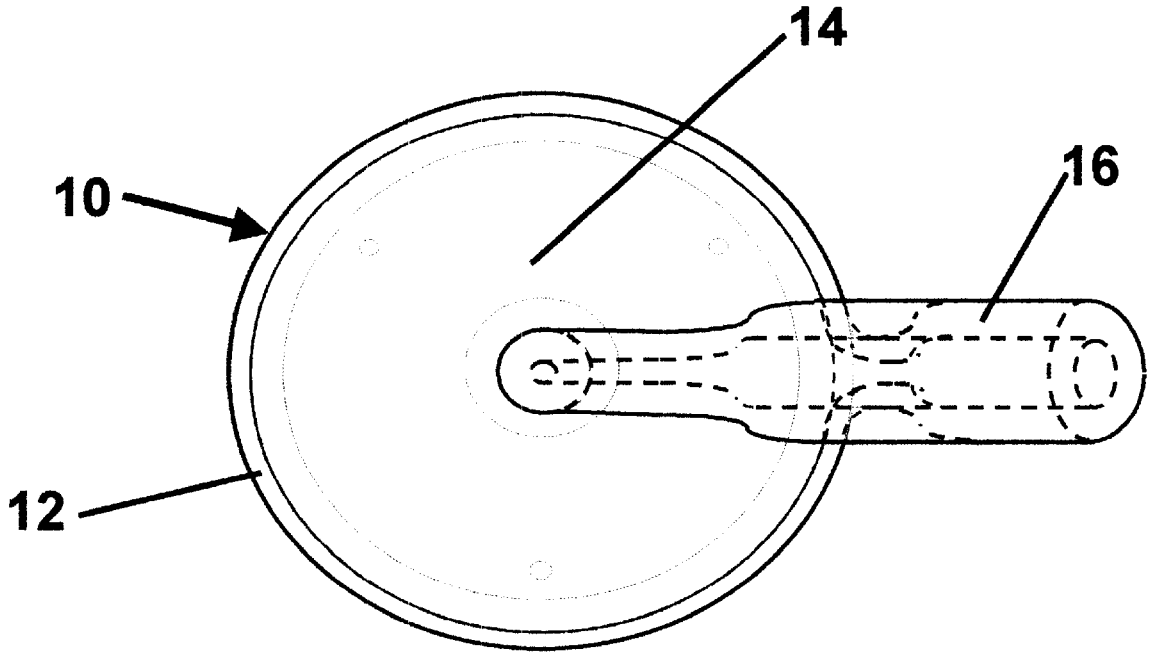
Figure 1E:
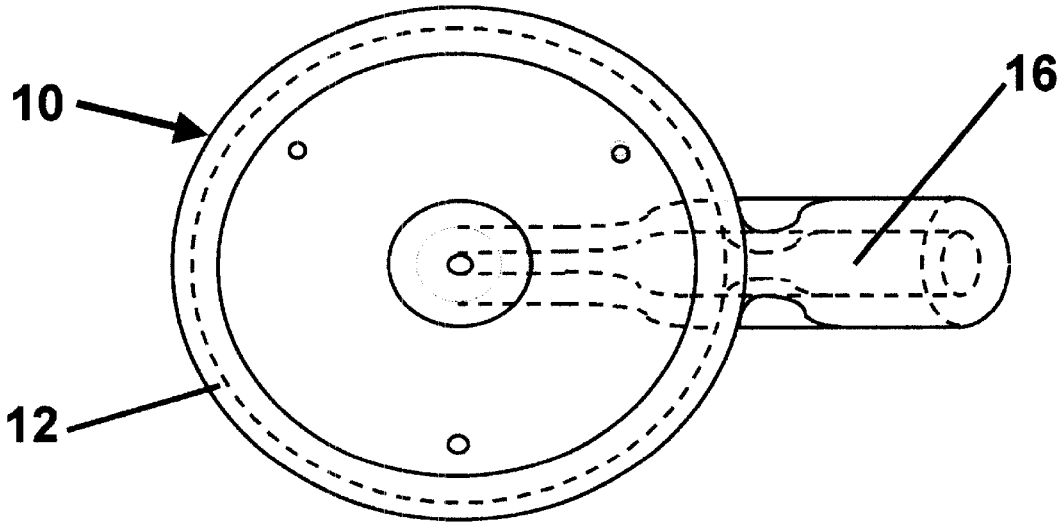
Figure 2A:
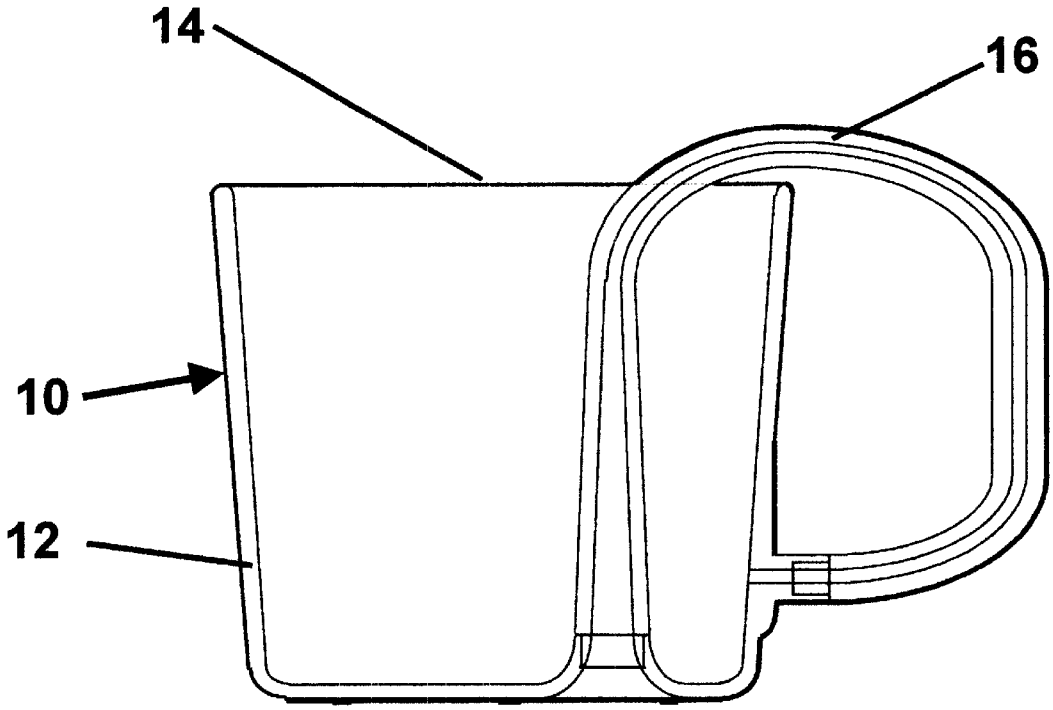
FIGS. 2A to 2D show various views of a tapered sided beverage vessel with the portion of the hollow handle within the container volume not centered in the container and largely perpendicular to the bottom of the container.
Figure 2B:
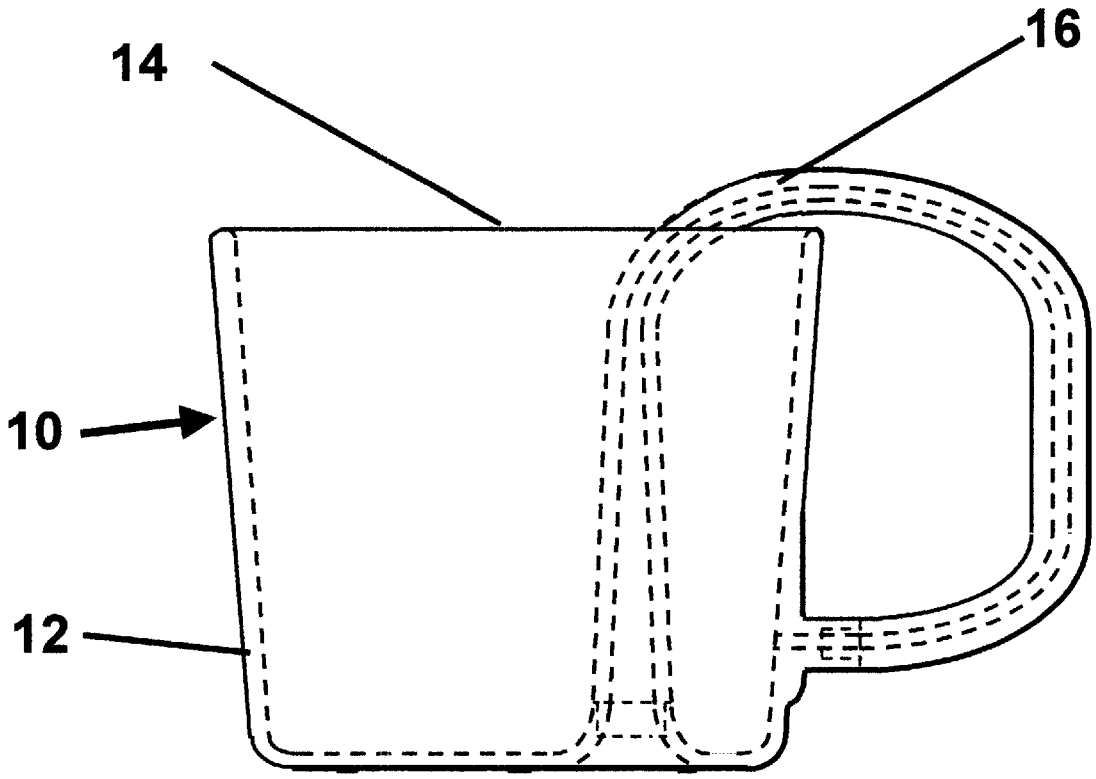
Figure 2C:
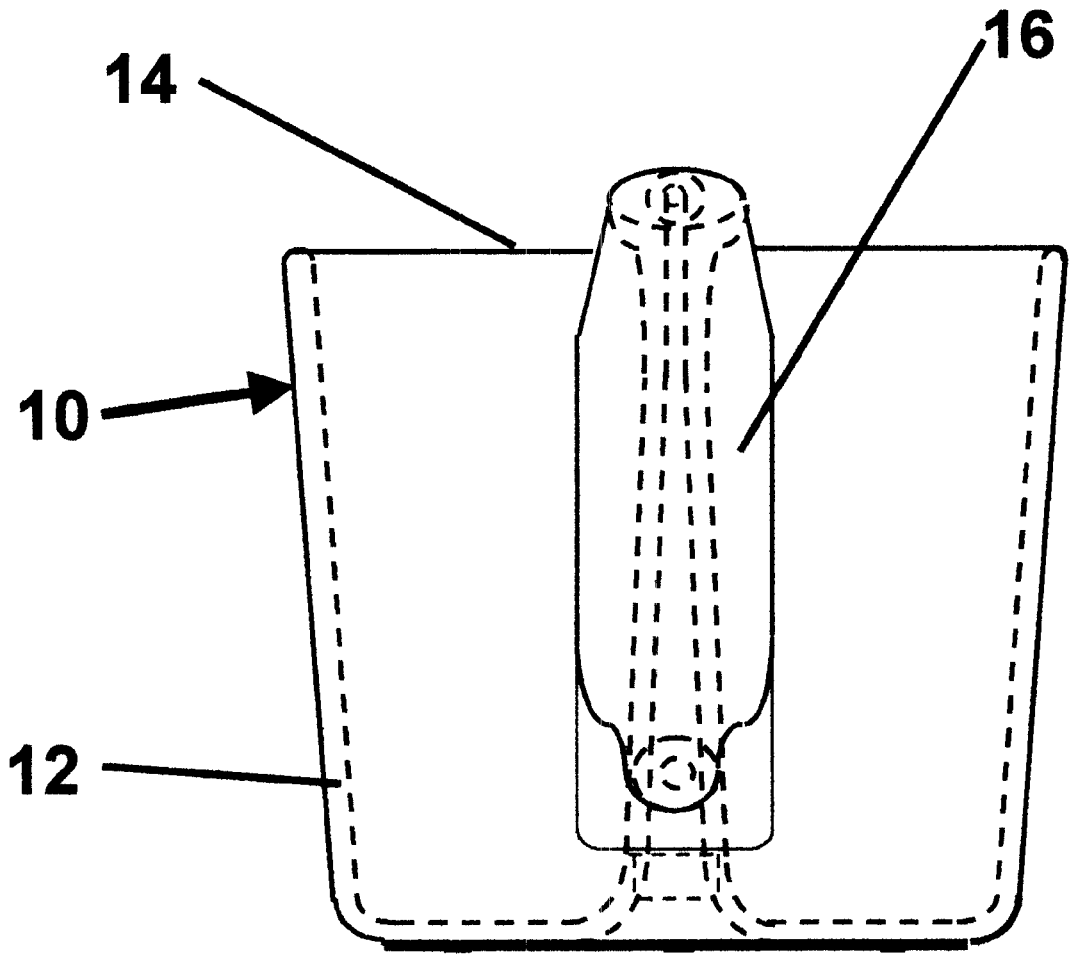
Figure 2D:
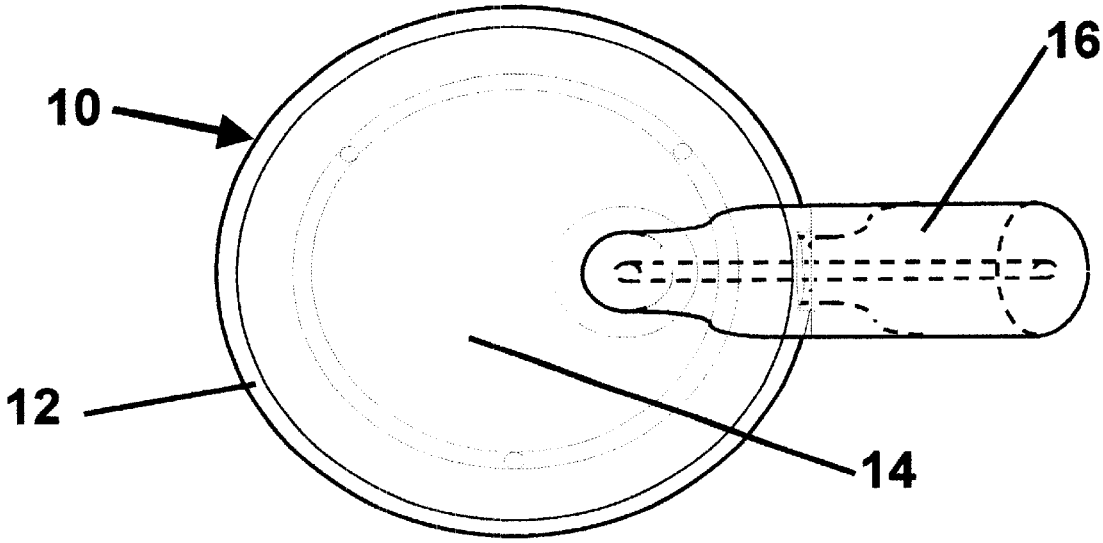

A typical embodiment of beverage vessel 10 is illustrated in FIG. 1A (cross sectional side view), FIG. 1B (side view perpendicular to plane of hollow handle), FIG. 1C (side view from handle side), FIG. 1D (top view) and FIG. 1E (bottom view). In the FIG. 1A through 1E illustrates a beverage vessel 10 with a straight sided container 12 and a hollow sloping hollow handle 16 that is hermetically joined to the container 12 base within the container 12 with the other end of the hollow handle 16 extending over the lip of the container 12 opening 14 and hermetically joined to the lower portion of the side of the container 12. The hollow handle 16 facilitates the communication between the volume within the container 12 and the exterior environment around the base of the container 12 through the hollow handle 12 whose hollow portion continues through the bottom of the container 12 and the sidewall of the container 12. In the preferred embodiment, the container 12 and the hollow handle 16 are made of a transparent or translucent material such as polycarbonate or glass however any other material suitable for making a beverage vessel 10 is also suitable for use as the material of this type of beverage vessel 10. A transparent or translucent material allows the user of the beverage vessel 10 to more easily see the unusual one-sided characteristic of the beverage vessel 10.

Because of the unusual aspects of the shape of the beverage vessel 10, it requires an extremely complex mold to be able to produce the beverage vessel 10 as a one shot, monolithic single piece using an injection molding manufacturing technique. A less complex method of construction of the beverage vessel 10 is to separately produce a container 12, with suitable bosses for the attachment the hollow handle 16, and a hollow handle 16 and then hermetically join the hollow handle 16 to the container 12 to produce the complete beverage vessel 10. Any suitable means for hermetically joining the container 12 to the hollow handle 16 such as chemical bonding, welding, melting or gluing can be employed however the attachment method is not limited to these means.

FIG. 2 shows a different embodiment of the beverage vessel. Note that the lower the area on the side of the container 12 that the hollow handle 16 attaches, the large the percentage of the contents of the container 12 can be withdrawn by applying a partial vacuum below the container 12. Also, note that location and height of the hollow handle 16, where it extends above the opening 14 of the container 12, should be considered when selecting the embodiment for a specific design so that the hollow handle 16 does not interfere with the person drinking from or using the beverage vessel 10.

Operation—FIGS. 1 to 3

The manner for using the beverage vessel 10 of this presentation is identical to that of the hundreds of thousands of embodiments of beverage vessel 10 presently in use when the beverage vessel 10 is used in the typical situations. A person would fill and drink from the beverage vessel 10 just as they would if drinking from a common coffee mug or cup.

The beverage vessel 10 would be utilized as a teaching aid; to show how a common utilitarian object can exhibit unusual topological properties such as being one-sided. The beverage vessel 10 can be used as a "show and tell" example for use in explaining the seemly simple task of defining what portion of an object surface is part of the objects outside surface or inside surface. By using analogies such as; having a bug crawl from any spot on the beverage vessel 10 to any other spot without crossing over an edge, it is easy to show the unusual properties of the beverage vessel 10. An alternative teaching technique is to have the students envision having a little black magnet and a little white magnet clinging to each other through the wall of the container 12 with one being on the inside [sic] of the container 12 and the other being on the outside [sic] of the container 12. Moving one of the two magnets at a time will result in dragging the other magnet along such that you can reverse the initial location of the two magnets without having either of them cross over the lip of the container 12 at the container 12 opening 14. It is also thought provoking to ask if the students if they can think of any other everyday object that has this one-sided characteristic?

The beverage vessel 10 also has a useful property in that it can be used in every way as an otherwise normal beverage vessel 10 yet can have its contents withdrawn through its hollow handle 16 by the application of a reduced pressure at the base of the container 12. This property can be of use in allowing the beverage vessel 10 to be drained in the event of an unstable environment, such as a pilots cockpit might experience when encountering air turbulence.

Summary, Ramifications, and Scope

Accordingly, the reader will see that the beverage vessel of this disclosure can be used as a normal beverage vessel in day-to-day life while offering the additional unique and interesting features of mathematical novelty and curiosity.

As there are tens of billions of beverage vessels in existence today world wide, with hundreds of thousands of individual embodiments of beverage vessels, there is certainly no burning urgency for the addition of a new embodiment of beverage vessel so that people will not have to drink from their hands. This is however, a good example of the tremendous and apparently insatiable demand for beverage vessels, coffee mugs and coffee cups for utilitarian use as well as for "good-by" or novelty gifts. Beverage vessels will certainly continue to be on the list of; "the largest number of non-consumable household products to be purchased annually".

The idea that will make this beverage vessel something that a person will purchase as a good-by gift or novelty gift is that it can claim the very unique, but not blatantly obvious, property of having only one side. Even the sight of the advertised claim, seen on a box containing one of these beverage vessels in a gift shop, that "it has only one surface—no inside and outside—just one surfaces", grabs ones attention because of the apparent illogic of the statement. It is unusual for such a simple common appearing object to be able to be used to convey the otherwise difficult concept of a one-sided, three-dimensional structure that can hold fluid. While the true Klein Bottle is a perfect example of a structure in four-dimensional space (not counting time as a dimension) that only has one surface, it is an imperfect representation when subjected to the realities imposed by our three-dimensional space. The beverage vessel described in this presentation, conveys the unique one-sided feature of the Klein Bottle while existing as a utilitarian object in our real world three-dimensional space.

Due to the unusual properties of this beverage vessel, it can be quickly drained of its contents if a partial vacuum is applied to it at the surface that it is sitting on. The required vacuum would be produced, contained and applied using commonly available items. This would allow its use as a coffee cup in the cockpit of an aircraft where it might be excessively inconvenient or expensive if air turbulence were to cause the beverage vessels contents to spill all over the cockpit instrumentation. The application of a reduced air pressure, at the surface that the beverage vessel is sitting on, results in a difference in pressures across the container contents. This difference in pressure pushes the containers contents up through the hollow handle, that is attached at the side of the container, over the container lip at the opening of the container and down through the hollow handle and out the hole at the bottom of the container.

Although the description above contains many specificities, these should not be construed as limiting the scope of the invention but as merely providing illustrations of some of the presently preferred embodiments of the invention. For example the beverage vessel container and hollow handle may have many other shapes and designs. The beverage vessel container may be a hollow oval in horizontal cross section or some more complex or convoluted shape while the hollow handle may be in turn be a hollow oval or hollow square or hollow triangular or some other hollow shape to provide better grip when handling the beverage vessel.

Thus, the scope of the invention should be determined by the appended claims and their legal equivalents, rather than the examples given.

The invention claimed is:

1. A beverage vessel, which comprises:

a container formed with an opening at the top end thereof;

said opening formed by the joining of the inner and outer wall surface at the lip of said container, said container also having provision for attachment of a hollow handle in the bottom of said container and in the lower side of said container, said hollow handle joined to the bottom of said container and hermetically sealed to the bottom of said container then passing out of said opening of said container with the other end of said hollow handle joined to the side of said container and hermetically sealed to said container so that the hollow handle communicates with the outside environment at the bottom end of said container and the internal volume of said container through said hollow handle.

2. The beverage vessel as set forth in claim 1, which embodies the topological property of having only one surface while fulfilling a utilitarian function as said beverage vessel.

3. The beverage vessel as set forth in claim 1, which can be quickly emptied by sucking said container contents through said hollow handle at the bottom side of said container and expelling the contents out of said container through said hollow handle at the bottom of said container if there is a need to empty said container without spilling or pouring the contents over the lip of said opening of said container.

* * * * *